United States Patent [19]

Karn et al.

[11] 4,267,006

[45] May 12, 1981

[54] LABEL PRINTING APPARATUS

[75] Inventors: Donald L. Karn, Springboro; James A. Makley, Miamisburg, both of Ohio

[73] Assignee: Monarch Marking Systems, Inc., Dayton, Ohio

[21] Appl. No.: 81,374

[22] Filed: Oct. 3, 1979

[51] Int. Cl.[3] ..... B65C 11/02

[52] U.S. Cl. ..... 156/384; 101/288; 156/541; 156/577; 156/584; 156/DIG. 39; 156/DIG. 49

[58] Field of Search ..... 156/384, 523, 527, 577, 156/584, 541, 579, DIG. 39, DIG. 47, DIG. 49; 101/287, 288

[56] References Cited

U.S. PATENT DOCUMENTS

| | | | |
|---|---|---|---|
| 4,102,731 | 7/1978 | Hamisch, Jr. | 156/541 X |
| 4,111,735 | 9/1978 | Hamisch, Jr. | 156/384 |
| 4,111,736 | 9/1978 | Hamisch, Jr. | 101/288 X |
| 4,116,747 | 9/1978 | Hamisch, Jr. | 156/384 |

FOREIGN PATENT DOCUMENTS 1155390 10/1963 Fed. Rep. of Germany .

*Primary Examiner*—Michael G. Wityshyn
*Attorney, Agent, or Firm*—Jacox & Meckstroth

[57] ABSTRACT

A hand held labeler has a movable print head with selectable printing means for successively printing character lines on a series of pressure sensitive labels carried by a web from which the printed labels are successively delaminated. The labeler includes a label applicator formed by a plurality of wheels mounted for rotation on a support shaft and having label engaging peripheral surfaces. The label applicating wheels are adapted to be assembled on the shaft in different arrangements with each other and with spacer members for selectively locating the label engaging peripheral surfaces according to the location of the character lines printed on the labels to avoid engaging the lines before applicating and before the printing ink sets.

11 Claims, 12 Drawing Figures

LABEL PRINTING APPARATUS

BACKGROUND OF THE INVENTION

In a hand held portable label printing apparatus or labeler, for example, of the type disclosed in U.S. Pat. Nos. 4,100,852 and 4,116,747 which issued to the assignee of the present invention, a series of pressure sensitive labels are carried by a web and are successively advanced over a platen where each label is printed with predetermined information by a set of selectable endless printing bands forming part of a movable print head. After each label is printed, the carrier web is advanced around a delaminator or peel edge where the printed label is peeled from the carrier web for application to an article by means of an applicating back-up roller or wheels. The movement of the print head and the alternating advancement of the carrier web are produced by an indexing mechanism which is preferably actuated by a trigger forming part of the handle portion of the labeler.

In a labeler of the type generally described above, it is common to use an ink applying roller which is supported for movement across the selected printing characters in response to movement of the print head. For example, in the hand-held labeler disclosed in above-mentioned U.S. Pat. No. 4,116,747, the holder for the ink roller is shown in FIGS. 1, 10 and 11 and is pivotally supported by a pivotal cover section of the labeler housing. The ink roller holder is deformable to release the journals of the ink roller from corresponding holes formed within the holder, and a new ink roller is inserted by snap-fitting the end journals into the bearing holes.

The cover section of the labeler housing is pivotally supported by a cross pin or shaft which also supports a pair of label applicator or applicating wheels, as shown in FIG. 12 of U.S. Pat. No. 4,116,747. The applicating wheels are spaced apart by a molded plastic U-shaped spring element which connects with a pivotal holder for the ink applying roller and is effective to urge the holder in a direction so that the ink applying roller contacts the selected printing characters on the endless printing band.

As mentioned in U.S. Pat. No. 4,102,731 which also issued to the Assignee of the present invention, the label applicating wheels described in connection with FIGS. 20–23 are positioned so that the outer label engaging peripheral surfaces of the wheels do not engage the labels in the areas where the labels have been printed so that wet printing ink is not smudged during application of the labels. Similarly, the applicating roll disclosed in German Pat. No. 1,155,390 is constructed with axially spaced circumferential grooves which define therebetween peripheral surfaces on contactng each label between the printed characters on the label.

SUMMARY OF THE INVENTION

The present invention is directed to labeling apparatus of the general type referred to above and which incorporates an improved label applicator adapted to be conveniently assembled in different arrangements for accommodating different multiple line printing heads. Each assembly of the applicator is effective to press printedlabels onto corresponding articles without contacting the printed characters on each label. Thus the labeling apparatus of the invention provides for selectively using selectable multiple line printing heads within a portable hand-held labeler and for conveniently assembling the label applicator in a manner which corresponds to a selected printing head.

In accordance with one embodiment of the invention, the label applicator incorporates a plurality of label back-up wheels each of which is non-symmetrical in a radial plane but are supported on a common shaft for independent rotation. Each of the applicating wheels has a peripheral label engaging surface, and the axial spacing between the peripheral surfaces of adjacent wheels is selected according to the orientation of the wheels and the location of spacing elements between the wheels. The manner in which the label applicating wheels and the spacers are assembled on the shaft corresponds to the selected print head and the selected arrangement of endless printing bands assembled within the print head. In the one embodiment, the spacers used in association with the applicating wheels are formed by a set of non-symmetrical spring elements which may be assembled in different arrangements on the shaft and also function to urge or bias the ink applying roll towards the printing characters on the endless bands.

Other features and advantages of the invention will be apparent from the following description, the accompanying drawing and the appendant claims.

DESCRIPTION OF THE PREFERRED EMBODIMENT

Figure 1:
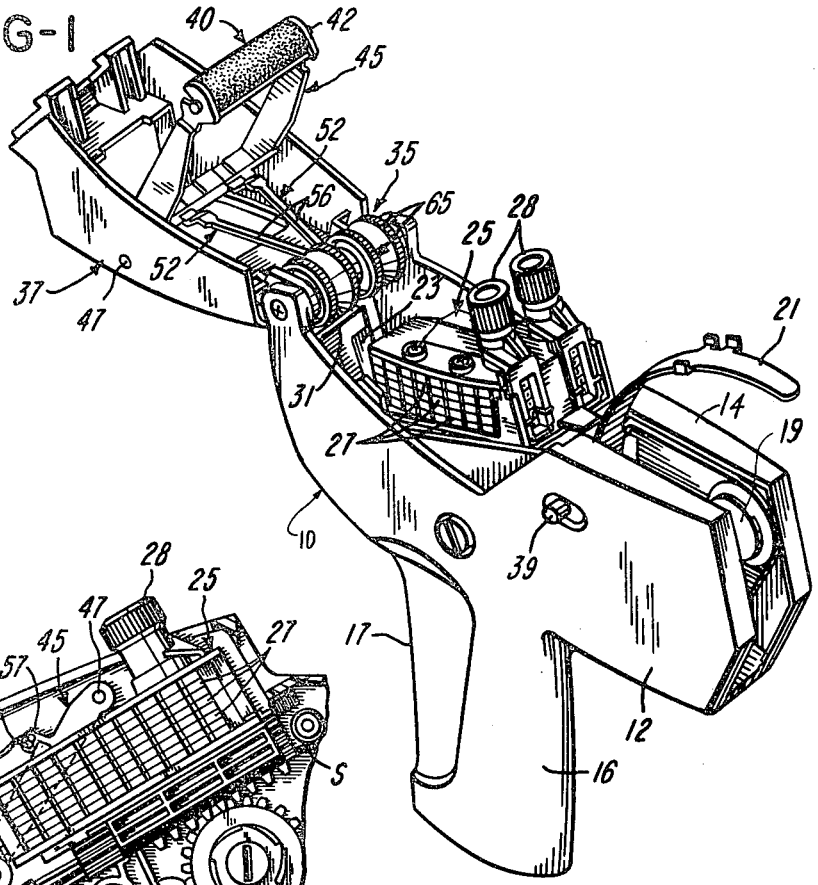
FIG. 1 is a perspective view of a hand-held labeler having a print head cover section shown in its open position and illustrating a label applicator constructed and assembled in accordance with the invention.

The hand-held labeler illustrated in FIG. 1 incorporates a housing 10 which includes two mating side sections 12 and 14 which are preferably molded of a plastics material. The housing also includes a handle portion 16 having a finger operated trigger actuator 17. The specific construction of the housing 10 and the components enclosed therein are described in above-mentioned U.S. Pat. No. 4,100,852 and No. 4,116,747. The labeler is adapted to receive a supply of pressure sensitive labels L which are carried by a web W and wound into a roll (not shown) inserted between the opposing freely rotatable core or hub elements 19. A molded plastic leaf spring 21 guides the strip S of web and labels into the labeler, and the strip is directed upwardly across the inner surface of a flat platen 23 where the labels are successively printed by the reciprocating movement of a print head 25. The print head is illustrated in the form of a dual line printing head, but may also be in the form of a single line printing head. Each line of printing is selected by individually positioning a set of movable endless flexible printing bands 27 through adjustment of corresponding band setting units 28.

As disclosed in the above-mentioned patents, after each pressure sensitive label is printed on the platen 23 by movement of the print head 25 in response to retraction of the trigger 17, the label strip S is advanced by a predetermined increment when the trigger 17 is released. The printed label is peeled from the carrier web at a delaminator 31 where the carrier web reverses and is directed downwardly and rearwardly through the labeler and around a ratchet type indexing drive wheel enclosed within the housing 10. As each printed label L is fed past the delaminator 31, the label is positioned to be applied to an article by a label applicator 35 which will be later described.

In a manner as illustrated in above-mentioned U.S. Pat. No. 4,116,747, the print head 25 is enclosed or covered by a molded plastic cover section 37 which is pivotally connected to the mating housing sections 12 and 14 by a cross shaft 38 molded as an integral part of the housing section 14. The closure or cover section 37 is retained within its closed position by a latch mechanism which is released by pulling rearwardly on a set of outwardly projecting latch actuator knobs or pins 39, as explained in above-mentioned U.S. Pat. No. 4,116,747.

A replaceable ink applying roller 40 includes a porous ink retaining body or tube which is mounted on a pair of opposing hub members having corresponding outwardly projecting end journals 42. The ink roller 40 is supported and carried by a frame or holder 45 which is preferably molded of a plastics material and has a set of trunions 47 projecting outwardly into aligned holes within the cover section 37 to form a pivot axis for the holder 45. The ink applying roller 40 and holder 45 are biased or urged toward a position where the ink roller engages the printing characters on the bands 27 and rolls across the characters in response to forward movement of the printing head 25. The biasing force is produced by a pair of spring members or elements 52 (FIG. 6) which are also molded of a plastics material such as nylon.

Each spring element 52 includes an annular hub portion 53 from which extends a flexible leg portion 56 terminating with a cross pin 57. The cross pin 57 projects into a corresponding slot 59 (FIG. 2) molded within the ink roller holder 45 to form a sliding pivot connection. Each of the spring elements 52 also includes an integrally molded slotted tab 63 which receives the cover section 37 (FIG. 2) and prevents the spring element from rotating on the shaft 38 when the leg portion 56 is pressed upwardly (FIG. 2) by the camming action of the inking roller 40 against the selected printing characters on the printing bands 27 as the printing head is advanced. The construction of each spring element 52 is similar to the spring elements disclosed in the abovementioned U.S. Pat. No. 4,116,747. However, the leg portion 56 of each spring element 52 extends transversely and forms an acute angle with a plane perpendicular to the axis of the hub portion 53 and the shaft 38, as shown in FIG. 6.

Figure 2:
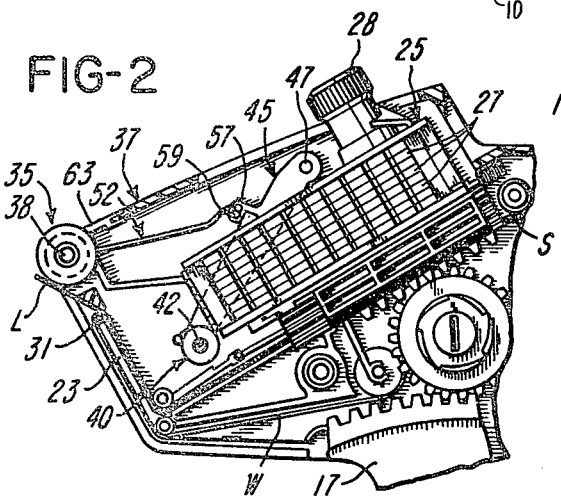
FIG. 2 is a fragmentary vertical section taken through the labeler shown in FIG. 1 and with the cover section shown in its closed position.

As mentioned above, after each printed label L is peeled from the carrier web W, as shown in FIG. 2, the label is applied to an article by an applicator 35. The applicator 35 includes a plurality of label applicating wheels 65 (FIGS. 3 and 6) each of which is molded from a resilient rubber-like material and has a peripheral ribbed or knurled surface 67 and an offset hub portion 68 having a frusto-conical outer surface.

Figure 3:
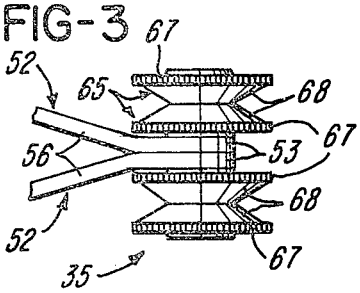
FIG. 3 is a plan view of one assembled arrangement of the label applicator shown in FIG. 1.
Figure 4:
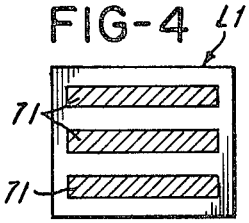
FIGS. 4 and 5 are diagrammatic plan views of different printed labels which are applied by the applicator arrangement shown in FIG. 3.
Figure 5:
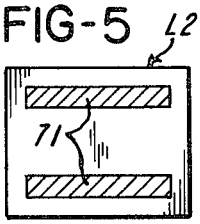
Figure 6:
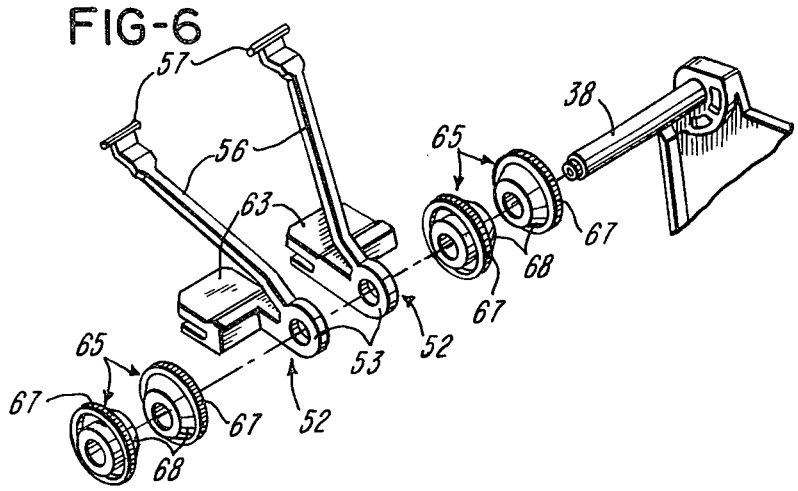
FIG. 6 is an exploded perspective view of the label applicator arrangement shown in FIGS. 1 and 3.

When the labeler is assembled with a print head 25 which is effective to print a series of labels L1 (FIG. 4) each having three parallel printed lines 71 or is assembled to print a label L2 (FIG. 5) having two parallel printed lines 71, the applicating wheels 65 are assembled on the support shaft 38 in a manner as shown in FIGS. 3 and 6. In this assembly, two pairs of applicating wheels 65 are arranged so that the hub portions 68 of each pair of wheels are in opposed relation, and the hub portions 53 of the spring element 52 are arranged or assembled to form a spacer between the two pairs of applicating wheels. In this arrangement of the applicating wheels 65, the printed lines 71 on the labels L1 or L2 pass between the peripheral label engaging surfaces 67 of the applicating wheels 65 so that the printed lines are not smudged or contacted by the pressure applying peripheral surfaces 67 of the wheels 65.

Figure 7:
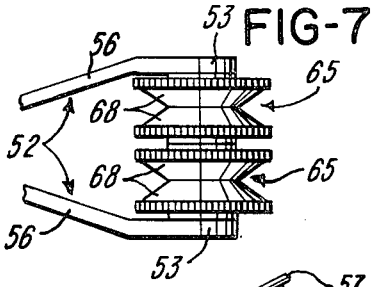
FIG. 7 is a plan view similar to FIG. 3 and showing another assembly of the label applicator.
Figure 8:
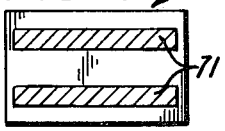
FIGS. 8 and 9 are diagrammatic plan views of different printed labels which are applied by the applicator assembly shown in FIG. 7.
Figure 9:
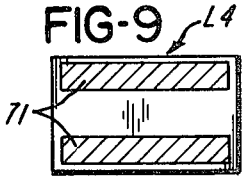
Figure 10:
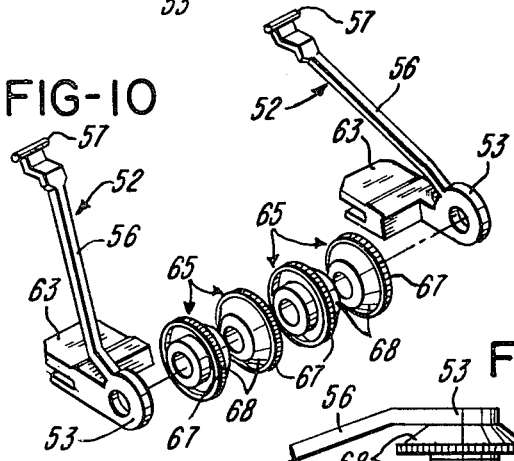
FIG. 10 is an exploded perspective view, similar to FIG. 6, of the applicator assembly shown in FIG. 7.

When it is desired to select a print head 25 and to assemble the labeler for printing a series of labels L3 (FIG. 8) or a series of labels L4 (FIG. 9) having two printed character lines 71, the two pairs of applicating wheels 65 are assembled on the shaft 38 in a manner as shown in FIGS. 7 and 10 with all of the applicating wheels located between the hub portions 53 of the spring elements 52. Thus the spring elements 52 are constructed so that they may be assembled on the shaft 38 in a manner as shown in FIGS. 3 and 6 with the hub portions 53 forming spacers between the two pairs of applicating wheels 65 or the spring elements 52 may be assembled on the shaft 38 in a manner as shown in FIGS. 7 and 10 where the hub portions 53 of the spring elements 52 straddle the two pairs of applicating wheels 65.

Figure 11:
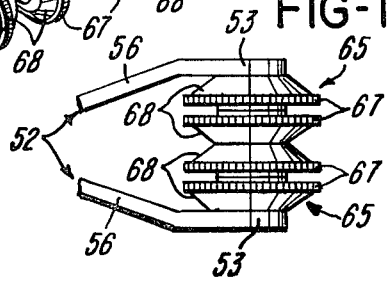
FIG. 11 is a view similar to FIGS. 3 and 7 and showing another assembly of the label applicator.
Figure 12:
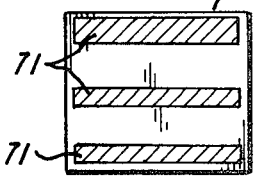
FIG. 12 is a diagrammatic plan view of a printed label which is applied by the applicator assembly shown in FIG. 11.

While FIGS. 7 and 10 illustrate each pair of applicating wheels 65 assembled in the same manner or orientation as each pair of applicating wheels 65 illustrated in FIGS. 3 and 6, the applicating wheel 65 may also be arranged or assembled on the shaft 38 in a different manner, for example, as illustrated in FIG. 11. In this assembly, the peripheral label engaging surfaces 67 of each pair of wheels 65 are arranged in adjacent relation. In this arrangement, the applicating wheels 65 are particularly suited for applying a label L5 (FIG. 12) having three printed character lines 71 but with greater spaces between the lines than the lines 71 on the label L1 shown in FIG. 4.

It is thus apparent from the drawings and the above description that a labeler or labeling apparatus incorporating a label applicator constructed in accordance with the present invention, provides desirable figures and advantages. For example, the construction of each applicating wheel 65 provides for assembling the applicating wheels on the support shaft 38 in various different arrangements so that different printing heads may be used in the labeler, and the printed character lines on the different labels are not engaged or contacted by the peripheral pressure applying surfaces 67 of the applicating wheels. In addition, the construction of the spring elements 52 provides for mounting or assembling the spring elements in different arrangements on the support shaft 38 so that the hub portions 53 of the spring elements may also be used as spacers either between the applicating wheels or outboard of the applicating wheels, thereby providing for further arrangements or locations of the peripheral surfaces 67 of the applicating wheel 65.

While the form of labeling apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Labeling apparatus adapted for successively printing, dispensing and applying a series of pressure sensitive labels to corresponding articles, said apparatus comprising means for supporting a supply roll of pressure sensitive labels carried by a web, selectable printing means for printng selected characters on each label, means for advancing the web, means for delaminating each printed label from the web in response to advancement of the web, a label applicator including a series of separate label applicating wheels mounted on a support shaft, each said wheel having a peripheral surface positioned to engage the printed side of each label for pressing the label against the corresponding article being labeled, each said wheel having a hub portion projecting axially from said peripheral surface by a predetermined distance to provide said wheel with a non-symmetrical cross-sectional configuration, and means for arranging said hub portions of said wheels at different axial positions on said shaft for positioning the corresponding peripheral surfaces at different axial positions to accommodate labels printed at different locations by different arrangements of said printing means and to engage an unprinted portion of each printed label.

2. Labeling apparatus as defined in claim 1 wherein each said hub portion has a frusto-conical outer surface.

3. Labeling apparatus as defined in claim 1 and including at least one spacer member mounted on said support shaft and adapted to be assembled in different arrangements with said applicating wheels on said support shaft.

4. Labeling apparatus adapted for successively printing, dispensing and applying a series of pressure sensitive labels to corresponding articles, said apparatus comprising a hand-held body including means for supporting a supply roll of pressure sensitive labels carried by a web, means for printing selected characters on each label, means for advancing the web in successive increments, means for delaminating each printed label from the web in response to advancement of the web, a label applicator including a series of separate label applicating wheels mounted on a support shaft, each said wheel having a peripheral surface positioned to engage the printed side of each label for pressing the label against the corresponding article being labeled, each said wheel having a hub portion projecting axially on one side to provide said wheel with a non-symmetrical configuration in axial cross-section, a set of spacer members mounted on said shaft with said applicating wheels, and means for selecting different axial spacing between said spacer members on said shaft to change the relative axial positions of said label engaging peripheral surfaces of said applicating wheels for accommodating labels printed at different locations by different arrangements of said printing means and for engaging an unprinted portion of each printed label.

5. Labeling apparatus adapted for successively printing, dispensing and applying a series of pressure sensitive labels to corresponding articles, said apparatus comprising means for supporting a supply roll of pressure sensitive labels carried by a web, selectable printing means for printing selected characters on each label, means for advancing the web, means for delaminating each printed label from the web in response to advancement of the web, a label applicator including a series of label applicating wheels mounted on a support shaft, each said wheel having a peripheral surface positioned to engage the printed side of each label for pressing the label against the corresponding article being labeled, spacer means mounted on said shaft with said applicating wheels, and means for selectively positioning said spacer means and said applicating wheels on said shaft in different arrangements for selecting different axial positions of said label engaging peripheral surfaces of said applicating wheels for accommodating labels printed at different locations by different arrangements of said printing means and for engaging an unprinted portion of each printed label.

6. Labeling apparatus as defined in claim 5 wherein said spacer means comprise a hub portion on at least one of said applicating wheels and providing said wheel with a non-symmetrical cross-sectional configuration.

7. Labeling apparatus as defined in claim 5 wherein said spacer means comprise a flexible spring member projecting at an acute angle with a plane perpendicular to said support shaft.

8. Labeling apparatus as defined in claim 5 wherein said spacer means comprise a set of spacer members constructed to be assembled on said shaft either between two of said applicating wheels or with all of said applicating wheels disposed between said spacer members.

9. Labeling apparatus as defined in claim 8 wherein each of said spacer members include a flexible spring portion projecting at an acute angle with a plane perpendicular to said support shaft.

10. Labeling apparatus as defined in claim 9 wherein each of said spacer members is adapted to be selectively assembled on said support shaft in two different axially spaced positions.

11. Labeling apparatus as defined in claim 5 wherein each said label applicating wheel includes a hub portion projecting axially to provide said wheel with a non-symmetrical configuration.

* * * * *